United States Patent [19]

Dyer

[11] Patent Number: 4,572,722

[45] Date of Patent: Feb. 25, 1986

[54] ABRASIVE COMPACTS

[76] Inventor: Henry B. Dyer, 28 George St., Bryanston, Transvaal, South Africa

[21] Appl. No.: 622,851

[22] Filed: Jun. 21, 1984

Related U.S. Application Data

[63] Continuation-in-part of Ser. No. 563,360, Dec. 20, 1983, abandoned.

[30] Foreign Application Priority Data

Oct. 21, 1982 [ZA] South Africa ..... 82/9369

[51] Int. Cl.[4] ..... B24D 3/02

[52] U.S. Cl. ..... 51/309; 51/308

[58] Field of Search ..... 51/308, 309

[56] References Cited

U.S. PATENT DOCUMENTS

| | | | |
|---|---|---|---|
| 3,136,615 | 6/1964 | Bovenkerk et al. | 51/307 |
| 3,141,746 | 7/1964 | De Lai | 51/307 |
| 3,233,988 | 2/1966 | Wentrof, Jr. et al. | 51/307 |
| 3,743,489 | 7/1973 | Wentrof, Jr. et al. | 51/307 |
| 3,767,371 | 10/1973 | Wentrof, Jr. et al. | 51/307 |
| 4,224,380 | 9/1980 | Bovenkerk et al. | 51/309 |
| 4,389,465 | 6/1983 | Nakai et al. | 51/309 |

FOREIGN PATENT DOCUMENTS

| | | |
|---|---|---|
| 0009315 | 4/1980 | European Pat. Off. . |
| 1598837 | 9/1981 | United Kingdom . |

*Primary Examiner*—Paul Lieberman
*Assistant Examiner*—Willie J. Thompson
*Attorney, Agent, or Firm*—Curtis, Morris & Safford

[57] ABSTRACT

In a method of removing second phase from an abrasive compact, the invention provides the improvement of forming a hole in the compact prior to or during the removal step. The compact is typically a diamond compact having a cobalt second phase. The preferred removal method is by leaching using as a leach medium hydrochloric acid in the presence of a platinum group metal catalyst.

10 Claims, 3 Drawing Figures

ABRASIVE COMPACTS

CROSS REFERENCE TO RELATED APPLICATION

This application is a continuation-in-part of my copending application Ser. No. 563,360, filed Dec. 20, 1983, now abandoned.

BACKGROUND OF THE INVENTION

This invention relates to abrasive compacts. Abrasive compacts are known in the art and consist of a mass of ultrahard abrasive particles bonded into a polycrystalline mass. The ultrahard abrasive particles currently known are diamond and cubic boron nitride. The abrasive particle content of abrasive compacts is greater than 70 percent by volume.

Abrasive compacts may be provided with a second or bonding phase or without such a phase. The second phase will generally contain a catalyst or solvent useful in the synthesis of the particular abrasive particle used in the compact. Examples of suitable catalysts or solvents for diamond synthesis are cobalt, iron and nickel. Examples of suitable catalysts or solvents for cubic boron nitride synthesis are aluminium or alloys containing aluminium.

One method of producing an abrasive compact with only a small amount of second phase is to produce a compact with such a phase and then remove substantially all that phase, e.g. by leaching. This method of producing abrasive compacts substantially free of a second phase suffers from the disadvantages that the removal step is very time consuming and does not always achieve a suitable reduction in the amount of second phase.

U.S. Pat. No. 4,224,380 discloses a temperature resistant abrasive compact and a method of making it including the steps of making an abrasive compact containing a second (metallic) phase and removing substantially all said second phase, as by leaching, e.g. acid leaching, electrolytic depletion, or liquid zinc extraction, so that the abrasive compact comprises between 0.05 and 3% by volume of said metallic phase.

SUMMARY OF THE INVENTION

In a method of removing second phase from an abrasive compact containing such a phase, the invention provides the improvement of creating a zone of increased surface area within the compact prior to or during the removal of the second phase. Removal methods include leaching methods such as acid leaching, electrolytic depletion, and liquid zinc extraction. The preferred removal method is a leaching method using a mineral acid and catalyst as more fully described hereinafter.

DESCRIPTION OF PREFERRED EMBODIMENTS

The zone of increased surface area will typically be a hole formed in the compact and extending inwardly from a surface thereof. Preferably, the hole extends from one surface of the compact to another surface of the compact. The hole may be made by methods known in the art such as by laser cutting or by spark erosion.

The hole typically has a circular cross-section of diameter no more than 30 microns.

The second phase which is located near the centre of the compact is generally the most inaccessible. Consequently, the zone of increased surface area should preferably be located, at least in part, in this region of the compact.

The abrasive compact may be a diamond or a cubic boron nitride compact as known in the art. Preferably, the compact is a diamond compact. The second phase may be any known in the art as described above.

Abrasive compacts and methods of making them are disclosed, for example, in U.S. Pat. Nos. 3,141,746, 3,136,615 and 3,233,988. Further, U.S. Pat. Nos. 3,745,623, 3,767,371 and 3,743,489 disclose composite abrasive compacts and methods of making them. The methods disclosed therein can be used to prepare the abrasive compacts, preferably with the modification that the material for the formation of the carbide support for the abrasive particle layer is omitted.

The preferred method of removing the second phase is by leaching using as the leach medium hydrochloric acid in the presence of a platinum group metal catalyst. The platinum group metals are ruthenium, rhodium, palladium, osmium, iridium and platinum. The preferred catalyst is platinum. The hydrochloric acid preferably has a concentration of 15 to 33 percent. It has been found that using such a leach medium results quicker, i.e. 3 to 7 percent quicker removal of the second phase when compared with other acid leaching mediums, e.g. aqua regia.

Figure 1:
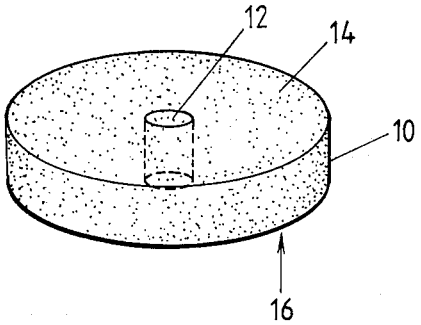
FIGS. 1 to 3 are diagrammatic views of abrasive compacts useful in the practice of the invention.
Figure 2:
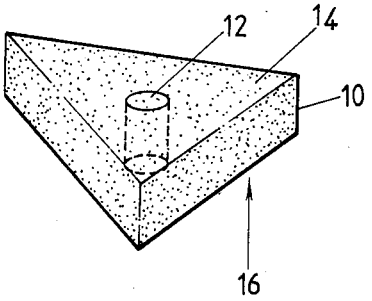
Figure 3:
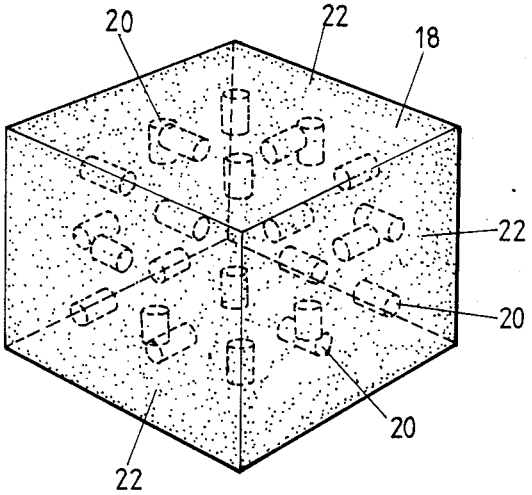

FIGS. 1 to 3 illustrate diagrammatically abrasive compacts useful in the practice of the invention. The compact 10 of FIG. 1 is of disc shape and has a hole 12 extending from one major flat surface 14 to the opposite major flat surface 16. FIG. 2 is similar to that of FIG. 1 except that the compact is of triangular shape. Like parts carry like numerals. The compact 18 of FIG. 3 is of cube shape and has a plurality of holes 20 extending inwardly from each flat side surface 22. The holes extend only partially into the cube and not from one side to the opposite side.

EXAMPLE I

A diamond compact was made in the conventional manner with a cobalt bonding phase. The diamond compact consisted of a polycrystalline mass of diamond particles having interspersed therethrough the cobalt bonding phase. The diamond particle content of the compact was 93 percent by volume and the cobalt content was 7 percent by volume. The compact was produced in the form of a disc having a diameter of 20 mm and a thickness of 3 mm.

The diamond compact was cut along planes transverse to the circular ends of the disc into a plurality of triangular and cube shaped fragments. The triangular fragments had sides of about 4 mm in length. The cubes had sides of about 3 mm in length.

Each fragment had formed therein by laser cutting, one or more small holes. In the case of the triangular fragments, a hole having a diameter of about 20 to 30 microns was formed from one major face of the other major face of each fragment. In the case of the cubes, small holes were formed in each face of the cube and extending close to the centre of the cube.

The fragments were placed in a hot mixture of hydrofluoric and hydrochloric acids for a period of several days. After this period, the fragments were found to have less than 1 percent by weight of the original cobalt. It was further found that the removal of the cobalt was achieved in a relatively short period of time and such removal was substantially uniform throughout each fragment. Removal methods other than acid leaching, e.g. electrolytic depletion or liquid zinc extraction, may be used.

The fragments so produced are capable of being used in a variety of abrading tools.

The pores of the leached fragments may be filled with a suitable inert material which does not detrimentally affect the diamond-to-diamond bonding of the polycrystalline mass at elevated temperature.

EXAMPLE II

The method of Example I was repeated on triangular fragments except that the leach medium was hydrochloric acid of 33 percent concentration containing a plurality of platinum strips. Effective removal of the cobalt phase was achieved in a period of 130 hours. To achieve the same degree of coblat removal using aqua regia required 180 hours.

I claim:

1. A method of removing a metallic second phase from an abrasive compact containing such a phase wich includes the step of increasing the surface area of the compact by forming a hole in the compact extending inwardly from a surface of the compact prior to or during removal of the second phase.

2. A method according to claim 1 wherein the hole extends from one surface of the compact to another surface of the compact.

3. A method according to claim 1 wherein the hole has a circular cross-section of diameter no more than 30 microns.

4. A method according to claim 1 wherein the hole is formed by laser cutting or spark erosion.

5. A method according to claim 1 wherein the hole is created, at least in part, in the central region of the compact.

6. A method according to claim 1 wherein the compact is a diamond compact and the second phase contains cobalt, nickel or iron.

7. A method according to claim 1 wherein the second phase is removed by leaching.

8. A method according to claim 7 the leaching medium is hydrochloric acid and a platinum group metal catalyst.

9. A method according to claim 8 wherein the hydrochloric acid has a concentration of 15 to 33 percent.

10. A method according to claim 8 wherein the catalyst is platinum.

* * * * *